US009327868B1

(12) United States Patent
Marquis et al.

(10) Patent No.: US 9,327,868 B1
(45) Date of Patent: May 3, 2016

(54) PALLET SYSTEM FOR CABLE-ENABLED LOADING

(71) Applicants: Michael Marquis, Savannah, GA (US); Gary Marquis, Bell, FL (US)

(72) Inventors: Michael Marquis, Savannah, GA (US); Gary Marquis, Bell, FL (US)

( * ) Notice: Subject to any disclaimer, the term of this patent is extended or adjusted under 35 U.S.C. 154(b) by 58 days.

(21) Appl. No.: 14/220,197

(22) Filed: Mar. 20, 2014

(51) Int. Cl.

| | |
|---|---|
| ***B65D 19/02*** | (2006.01) |
| ***B65D 19/00*** | (2006.01) |
| ***B65D 19/06*** | (2006.01) |
| ***B65D 19/36*** | (2006.01) |
| ***B65D 21/02*** | (2006.01) |

(52) U.S. Cl.
CPC ..... *B65D 19/02* (2013.01); *B65D 19/0002* (2013.01); *B65D 19/06* (2013.01); *B65D 19/36* (2013.01); *B65D 21/0201* (2013.01); *B65D 2519/00268* (2013.01); *B65D 2519/00756* (2013.01)

(58) Field of Classification Search
CPC ..... B65D 19/06; B65D 19/36; B65D 2519/00756; B65D 21/0201; B65D 19/02
See application file for complete search history.

(56) References Cited

U.S. PATENT DOCUMENTS

| | | | | | |
|---|---|---|---|---|---|
| 2,444,183 | A | * | 6/1948 | Cahners | 108/51.3 |
| 2,665,020 | A | | 1/1954 | Whittle | |
| 2,728,545 | A | * | 12/1955 | Hermitage | 108/51.3 |
| 2,783,011 | A | * | 2/1957 | Alexander | 108/51.3 |
| 2,820,560 | A | * | 1/1958 | Davis | 414/500 |
| 3,077,982 | A | * | 2/1963 | Berner | 206/600 |
| 3,199,765 | A | * | 8/1965 | Locke | 229/103.2 |
| 3,392,800 | A | | 7/1968 | Swamy | |
| 3,434,435 | A | * | 3/1969 | Achermann et al. | 108/51.3 |
| 3,464,371 | A | * | 9/1969 | Gifford | 108/51.3 |
| 3,499,397 | A | | 3/1970 | Johnson | |
| D219,582 | S | | 12/1970 | Stout | |
| 3,567,068 | A | * | 3/1971 | Carfizzi | 220/630 |
| 3,618,899 | A | * | 11/1971 | Hancock, Jr. | 254/396 |
| 3,796,279 | A | | 3/1974 | Burdick | |
| 4,095,769 | A | * | 6/1978 | Fengels | 248/346.02 |
| 4,203,697 | A | | 5/1980 | Cayton | |
| D263,389 | S | | 3/1982 | Nordstrom | |
| 4,397,246 | A | | 8/1983 | Ishida | |
| 4,421,353 | A | * | 12/1983 | Smith, Jr. | 294/82.1 |
| 4,694,962 | A | * | 9/1987 | Taub | 206/600 |
| 4,792,325 | A | * | 12/1988 | Schmidtke | 493/334 |
| 4,841,880 | A | | 6/1989 | Ferguson | |
| 4,850,283 | A | * | 7/1989 | Carvin | 108/51.11 |
| 4,863,024 | A | * | 9/1989 | Booth | 206/386 |
| 4,867,074 | A | * | 9/1989 | Quasnick | 108/51.3 |
| 4,890,560 | A | | 1/1990 | Good | |
| 5,022,809 | A | * | 6/1991 | Hinson | 414/494 |
| 5,069,143 | A | | 12/1991 | Bunger | |
| 5,163,807 | A | | 11/1992 | Gibson | |

(Continued)

FOREIGN PATENT DOCUMENTS

| | | | |
|---|---|---|---|
| DE | 9202514 | U1 * | 10/1992 |
| EP | 1702864 | A1 * | 9/2006 |

(Continued)

*Primary Examiner* — Terrell McKinnon
*Assistant Examiner* — Eret McNichols
(74) *Attorney, Agent, or Firm* — Sven W Hanson

(57) ABSTRACT

A novel pallet construction includes a rigid pallet body including a linear conduit passing through the pallet between opposing sides of the pallet and open at the ends of the conduit. The conduit includes a removable lining to prevent destruction of the pallet and conduit during use. In alternative configurations, two offset conduits may be provided to accommodate other hardware and use constraints.

3 Claims, 3 Drawing Sheets

(56) References Cited

U.S. PATENT DOCUMENTS

| | | | | | |
|---|---|---|---|---|---|
| 5,226,373 | A | | 7/1993 | Esch | |
| 5,333,555 | A | | 8/1994 | McPhee | |
| 5,355,786 | A | * | 10/1994 | Tipton et al. | 100/25 |
| 5,423,270 | A | * | 6/1995 | Kilpatrick et al. | 108/51.3 |
| 5,490,465 | A | * | 2/1996 | Hoyt et al. | 108/51.3 |
| 5,546,872 | A | | 8/1996 | Young | |
| 5,562,047 | A | * | 10/1996 | Forney et al. | 108/57.13 |
| 5,836,254 | A | * | 11/1998 | Johansson | 108/51.3 |
| 5,996,510 | A | | 12/1999 | Harpman | |
| 6,135,030 | A | | 10/2000 | Besaw | |
| 6,230,383 | B1 | * | 5/2001 | Welleman et al. | 29/430 |
| 6,264,410 | B1 | * | 7/2001 | Keip et al. | 410/35 |
| D450,906 | S | | 11/2001 | Schepers | |
| 6,311,371 | B1 | * | 11/2001 | Dazzo | 24/20 R |
| 6,394,003 | B1 | * | 5/2002 | Lacy, III | 108/51.3 |
| 7,637,219 | B2 | | 12/2009 | Hartel | |
| 7,802,527 | B2 | * | 9/2010 | Dong | 108/56.1 |
| 2005/0076816 | A1 | | 4/2005 | Nakano | |
| 2006/0060617 | A1 | * | 3/2006 | Facey et al. | 222/562 |
| 2009/0308289 | A1 | * | 12/2009 | Ferguson | 108/51.3 |
| 2010/0212982 | A1 | | 8/2010 | Lin | |
| 2011/0168766 | A1 | * | 7/2011 | Erdie | 229/103.2 |
| 2013/0145971 | A1 | * | 6/2013 | Federl et al. | 108/57.25 |
| 2015/0360811 | A1 | * | 12/2015 | Ness | |

FOREIGN PATENT DOCUMENTS

| | | | | |
|---|---|---|---|---|
| EP | 2230186 | B1 | * | 1/2013 |
| NL | 9300608 | A | * | 11/1994 |

* cited by examiner

PALLET SYSTEM FOR CABLE-ENABLED LOADING

BACKGROUND OF THE INVENTION

The present invention relates to pallets as structures for supporting, retaining and moving other objects. In general, a "pallet" as the term is used here refers to a rigid structure relatively planar with a thickness dimension substantially less than the orthogonal linear planar dimensions of the structure. The planar dimensions of a pallet may vary, but herein are considered typical pallet constructions with width and length planar dimensions in the range 48 inches to 110 inches. In no way are the above typical dimensions limiting of the aspects or utility of the present invention.

In use, objects of value or interest otherwise are secured to one or more pallets. The pallets provide a means of aggregating multiple objects in some instances. A valuable aspect of pallets in most applications is their providing a means or mechanism for moving the secured objects without further contact with the objects. This may be valuable where the objects of interest are fragile or do not themselves provide convenient structural features for applying forces for moving them by conventional transport devices.

In many applications, the transport device is in the form of a "forklift" which may be self-propelled or man-powered. Typically, the "fork" of the forklift is placed in a balanced position under the pallet, or within slots within the pallet body. In this manner, the forklift may be structurally positioned under the center of gravity to enable winching the pallet with its load of objects.

In some applications, use of a forklift is not feasible. For example, in confined transport vehicles such as helicopters and other aircraft designed for cargo transport, it is often necessary to move or position loaded pallets by man-power alone due to the unavailability, or the lack of clearance for the use, of forklifts. In some of these applications, it is possible to use cable winches to pull pallets into a transport vehicle space. For such applications, the pallets must be designed to survive the tension loads produced by such mods of movement which are not produced by simple lifting of the pallet from beneath—as with a forklift. A substantial difficulty exists with use of a cable winch in the above manner. Where multiple pallets must be moved and positioned in a row, with the same orientation and closely spaced (which is almost always desirable), it is often impossible to access all of the pallets. Where the desired position of the pallets is in a longitudinally oriented row, it is usually possible to winch only the first pallet before access to the cable winch is blocked. In this arrangement, the first pallet and its secured object(s) block the needed path of the cable for each subsequent pallet in the row.

What is needed is a pallet that allows passage of a cable to access each subsequent pallet, aligned with the first pallet, to allow cable winching of multiple pallets.

SUMMARY OF THE INVENTION

The present invention includes a rigid pallet body including at least one linear conduit passing through the pallet between opposing sides of the pallet and open at the terminal ends of the conduit. The conduit includes a removable and replaceable liner to prevent destruction of the pallet and conduit during use. In particular configurations of the invention, two similar conduits are provided located symmetrically spaced from the pallet centerline.

The invention includes a system of pallets including conduits with removable liners. The system allows pallets to be moved and mutually located closely spaced by passing a cable through a first pallet and connecting to a second pallet to draw the second to the first. The invention includes methods of moving pallets in which pallets according to the invention are manipulated in the manner described.

Other novel aspects and advantages of the invention are illuminated by the specific embodiments detailed below, and by the accompanying drawing figures and the associated claims.

DETAILS OF EMBODIMENTS OF THE INVENTION

Figure 1:
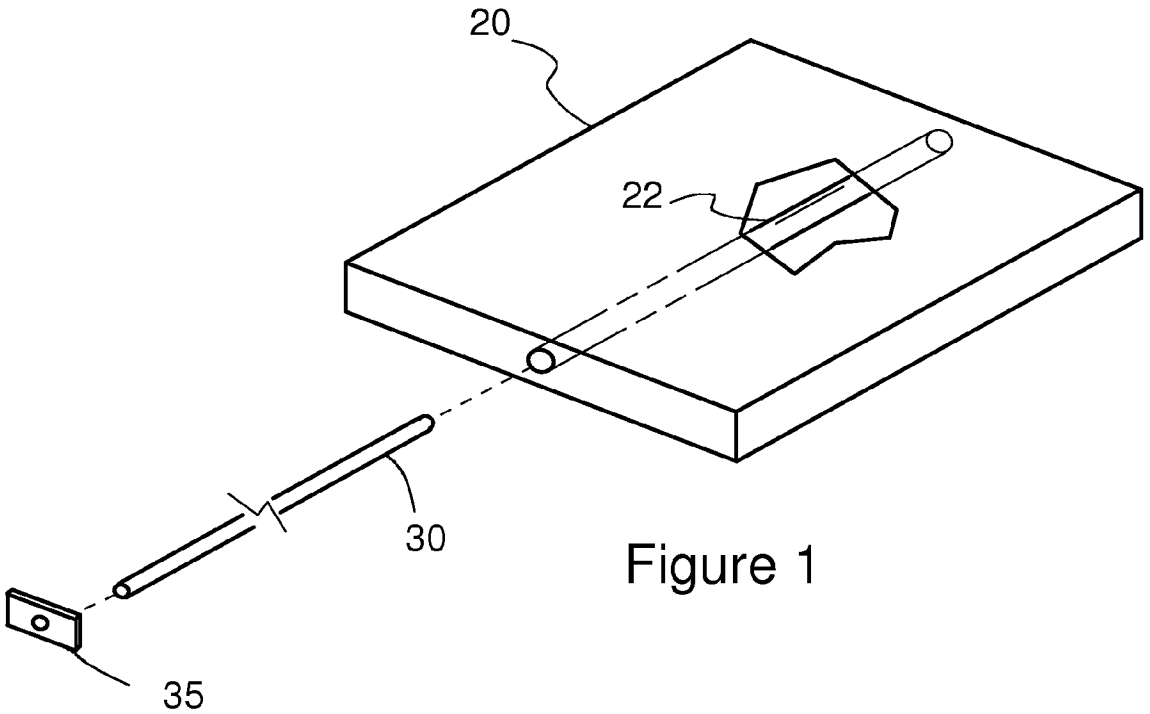
FIG. 1 is a perspective illustration of one configuration of the invention.
Figure 2:
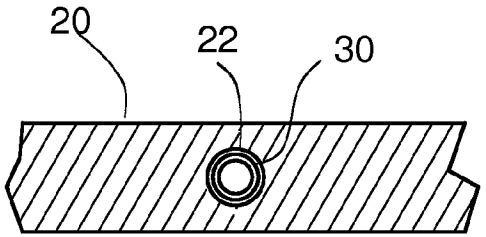
FIG. 2 is a detail section view from the configuration of FIG. 1.
Figure 3:
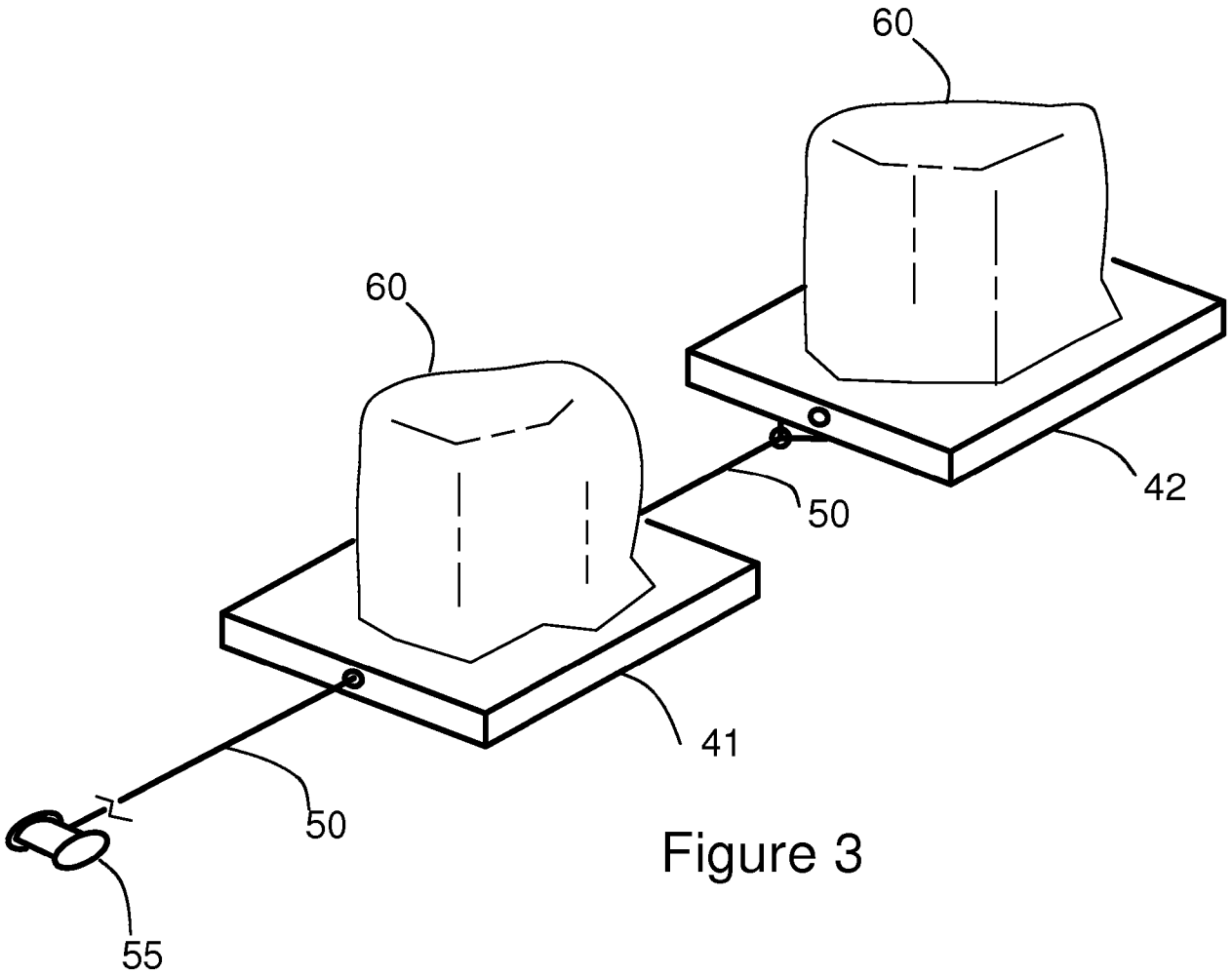
FIG. 3 is a perspective view of a system of pallets according to the invention.

FIGS. 1 and 2 regard a common configuration of the inventive pallet. FIG. 3 illustrates a system of pallets incorporating multiple pallets. The following discussion applies to all of the pallet constructions illustrated.

The inventive pallet includes a rigid pallet body 20 that is generally constructed similarly to conventional prior pallets. That is, the pallet body 20 is generally planar having a flat bottom to rest and slide on working surfaces such as storage buildings and transport vehicles. The upper surface of the pallet body 20 is most typically flat to accommodate supporting a wide variety of cargoes, although specialized shapes and constructions for securing and retaining particular cargoes may be used in the same way. The pallet body 20 is generally rigid relative to conventional cargoes and strong enough to resist distortion in operation. The materials and construction of the pallet body 20 may follow conventional constructions and applicable materials include wood, plastics and metals. The pallet body 20 may include other (not illustrated) features such as forklift slots for use of other associated devices and systems.

The inventive pallet includes a cable conduit 22 which is located within the pallet body 20, between the upper and lower surfaces, and extends fully between two opposing sides of the pallet body 20. Preferably, the conduit 22 is located symmetrically between the adjacent parallel sides of the pallet. The pallet body 20 in FIG. 1 is partially cut away to reveal the conduit 22 within. The conduit 22 is hollow and open at the opposing sides of the pallet body 20 to allow entry and exit of a cable through the conduit 22 and thereby effectively through the pallet body 20 at the same time.

The conduit 22 is preferably formed of aluminum tubing, although other rigid materials may be used, including steel and other metals. The conduit 22 must be substantially straight and unobstructed. The pallet body 20 and conduit 22 must be designed and assembled to provide rigid support of the conduit 22 within the pallet body 20. While the conduit 22 is not intended to sustain substantial forces in operation, use of the pallet itself may result in substantial distortion and upsetting forces and integrity of the conduit 22 within the pallet body 20 must be ensured.

An elongated hollow liner tube 30 is preferably formed of a solid rigid polytetrafluoroethylene (PTFE) extruded material. The material is selected for a combination of low friction and toughness against abrasion wear. Other Teflon (a registered trademark of the E. I. du Pont De Nemours and Company) containing materials and other materials having similar properties may be used. The liner tube 30 may also be a portion of and carried by a support structure, such a metallic outer tube that would be removably located within the conduit 22 in the same manner. The liner tube 30 outside diameter is sized to be removably placed into the conduit 22. A slip fit is suggested. The length of the liner tube 30 should be sufficient to fully cover the inside surface of the conduit 22.

The function of the liner tube 30 is to allow easy passage and movement of a conventional steel winch cable through the conduit 22 while protecting the conduit 22 from wear and to prolong the life of the conduit 22 and pallet. For this reason, the liner tube 30 must be removable and replaceable after wear in use. The wall thickness of the liner tube 30 is not critical, although sufficient radial dimension to provide substantial use of life is desirable. A liner wall thickness dimension of ⅛ is suggested for this purpose.

After placing the liner tube 30 into the conduit 22, the liner tube 30 is captured and secured by a conduit cap 35 in the form of a flat rigid plate that is secured onto the side of the pallet body 20 by threaded fasteners or other attachment devices. The cap 35 includes a circular aperture having a diameter slightly smaller that the outer diameter of the liner tube 30 so that just that the cap 35 overlaps a portion of the end section of the liner tube 30, leaving a portion exposed to indicate the level of wear over the use period of the liner tube 30. Other devices and mechanisms for securing the cap 35 are also contemplated and may be used for equal effect and result. Likewise, other mechanisms for temporarily securing the liner tube 30 within the conduit 22 may also be used. Such a mechanism may also be provided at the opposite end of the conduit 22 (opposing side of the pallet). Alternatively, one side of the conduit 22 may be sufficiently blocked to permanently prevent escape of the liner tube 30.

For most applications the conduit 22, with an installed liner tube 30, should have a finished inside diameter dimension of about 11/16 inches to accommodate a conventional winch cable with a terminal "eye". Larger conduit diameter dimensions will satisfy the functional requirements.

FIG. 3 illustrates how multiple matched pallets 41, 42 may be used in a system according to the invention to move and locate the pallets in a novel manner. In use, after the first matched pallet 41 is located, a winch cable 50 is passed through the conduit 22 of the pallet to reach the second matched pallet 42 to which the cable 50 is secured. The cable may be secured to the pallet in conventional manner. When an associated cable winch 55 is operated, the second pallet 42 may be dragged close to the first pallet 41.

Alternatively, the cable 50 may be passed also through the second pallet 42 to be secured to the backside of the second pallet 42 (not shown). In this way, when the cable tension is applied, the second pallet 42 is subjected to compression forces with less potential for distortion or destruction of the second pallet 42.

Figure 4:
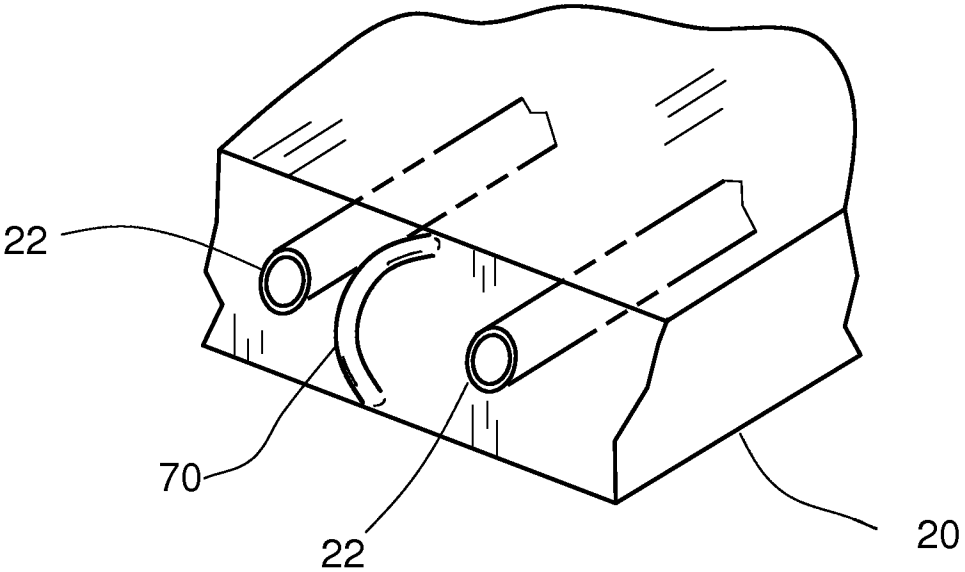
FIG. 4 is a perspective partial view of an alternative configuration of the inventive pallet.

FIG. 4 illustrates an alternative preferred configuration of a pallet according to the invention. Often it is desirable to have a center-side located accessory device on a pallet. One example is a "D" ring that is often used to attach cables or other tension elements. Such an example accessory structure 70 is shown in FIG. 4 in the form of a D-ring. To accommodate this configuration or other similar incidental requirements, it may be desirable to include in the pallet two conduits 22, each located offset and parallel from the pallet horizontal centerline. This is shown in the figure. Slight offset will not detrimentally affect the performance of the pallet system described.

In a preferred configuration specifically adapted to existing helicopters used to transport pallet-supported materials, the pallet bodies each have overall width and length dimension of about 88 and 108 inches, respectively. Two conduits 22 are configured as discussed above, but are each located symmetrically spaced 14 inches from the pallet centerline. This spacing is used to advantage to match the particular relative location of winch equipment in the aircraft.

The invention contemplates other equivalent materials and modes of construction that are known now or may be available in the future.

The invention claimed is:

1. A pallet comprising:

a rigid planar body for supporting and transporting cargo;

at least one rigid hollow elongated tubular conduit extending entirely through the body;

a tubular liner disposed within the conduit, the liner configured to prevent contact to the conduit by a cable passing through the conduit during use, the liner being removable and replaceable; and each conduit including a respective rigid cap retaining the liner within the conduit.

2. A pallet, according to claim 1, and wherein:

the at least one conduit comprises two conduits, the conduits located spaced symmetrically from the pallet centerline.

3. A pallet, according to claim 1, and wherein:

the liner comprises a tube formed comprising polytetrafluoroethylene.

* * * * *